US006325965B1

(12) United States Patent
Makita et al.

(10) Patent No.: US 6,325,965 B1
(45) Date of Patent: Dec. 4, 2001

(54) FORMING METHOD AND FORMING APPARATUS

(75) Inventors: Ken Makita, Osaka-fu; Masao Noumi, Kawanishi; Osamu Yamashita, Ibaraki, all of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/431,055

(22) Filed: Nov. 1, 1999

(30) Foreign Application Priority Data

Nov. 2, 1998 (JP) ..... 10-311876

(51) Int. Cl.[7] ..... B22F 1/00
(52) U.S. Cl. ..... 419/38; 419/23; 425/78
(58) Field of Search ..... 419/38, 23; 425/78

(56) References Cited

U.S. PATENT DOCUMENTS 3,599,578 * 8/1971 Sato ..... 107/17
5,672,363 * 9/1997 Sagawa et al. ..... 425/3
5,725,816 * 3/1998 Sagawa et al. ..... 264/102
5,945,135 * 8/1999 Beane et al. ..... 425/260
5,989,487 * 11/1999 Yoo et al. ..... 266/249
6,035,905 * 3/2000 Griffin ..... 141/181

FOREIGN PATENT DOCUMENTS 3-258498 11/1991 (JP) .
8-20801 1/1996 (JP) .
8-20802 1/1996 (JP) .
9-287001 11/1997 (JP) .
10-95532 4/1998 (JP) .

* cited by examiner

*Primary Examiner*—Daniel J. Jenkins
(74) *Attorney, Agent, or Firm*—Armstrong, Westerman, Hattori, McLeland & Naughton, LLP.

(57) ABSTRACT

A forming apparatus comprises a die formed with a through hole for provision of a cavity. A feeder box stored with a raw material powder having an average grain diameter of 0.1 μm~500 μm is positioned above the cavity of the die, and the raw material powder is allowed to fall into the cavity while an inside of the feeder box and an inside of the cavity are each maintained at a pressure not greater than 10 kPa. During the supply of the raw material powder, the feeder box may be vibrated, or the supply may be made via a hose. The raw material powder may be a granulated powder or a rare-earth alloy powder. The raw material powder supplied in the cavity is pressed by an upper punch and a lower punch into a compact.

13 Claims, 4 Drawing Sheets

FORMING METHOD AND FORMING APPARATUS

BACKGROUND OF THE INVENTION

1. Field of the Invention

The present invention relates to a forming method and a forming apparatus. More specifically the present invention relates to a forming method and a forming apparatus in which a raw material powder comprising a fine powder or a granulated powder made therefrom is supplied into a cavity of a die, and the raw material powder supplied in the cavity is pressed to form a compact.

2. Description of the Related Art

In a press forming method, a die is formed with a cavity opening upward. A feeder box containing a raw material powder is placed above the cavity. The raw material powder is supplied by gravitational fall from the feeder box into the cavity. Then, the supplied raw material powder is pressed into a compact by an upper punch and a lower punch. An advantage of this method is that a compact of a high density can be obtained. According to the press forming method, in general, an amount of a binder to be used can be smaller than in an injection molding method or an extrusion molding method. Further, an amount of time required to perform a cycle of formation is also smaller. For these reasons, the press forming method is widely used.

When the press forming method is used to manufacture a small compact, the cavity of the die must have an area of an opening which is made accordingly and therefore considerably small, causing a difficulty that the raw material powder will not fall easily into the cavity. This is due to a phenomenon known as the bridging phenomenon, which is unique to a powder material. The bridging phenomenon makes unstable the amount of supply of the raw material powder into the cavity, making difficult to manufacture the compact satisfying a dimensional requirement. Further, the supply of the raw material powder into the cavity takes a longer time, increasing the amount of time required to perform the cycle of pressing operation.

In order to avoid the bridging phenomenon, there is employed a method of adding a binder to a powder thereby making a granulated powder having a greater grain diameter than the original powder grain (See Japanese Patent Laid-Open No. 8-20801, Japanese Patent Laid-Open No. 8-20802, and Japanese Patent Laid-Open No. 9-287001, for example). The granulated powder has a dramatically smaller contact area among granules, having a remarkably improved flowability. As a result, many small ceramic parts are now manufactured from the granulated powder, by using the press forming method.

On the other hand, a development is made also for a forming apparatus to avoid the bridging phenomenon, by utilizing a magnetic field or an ambient pressure difference, for example, in sucking the raw material powder into the cavity. Specifically, as a method of using the pressure difference, a proposal is made, in which the lower punch is quickly lowered when the feeder box comes above the cavity so as to create a partial vacuum within the cavity for sucking the raw material powder. In another proposal, the die is provided with a vent hole for sucking air from inside the cavity so that the raw material powder is supplied into the cavity under partial vacuum.

However, even if the granulated powder is used according to the former proposal, there is still a limit to catch up with further miniaturization of the parts, while there is a difficulty in further increasing a speed of the formation.

On the other hand, according to the latter proposal in which a relatively large pressure difference is created between inside and outside of the cavity for sucking the raw material powder, it is possible to quickly supply the raw material powder into the cavity. However, there is a narrow gap between the die and the lower punch from which a high pressure gas is discharged, allowing the raw material powder to build up in the gap. This can cause damage to the die when the lower punch is moved relative to the die, or cause seizure between the lower punch and the die. These problems interfere with continuous formation. Further, said sucking method can cause a fire accident, due to an excessive friction during the operation if the raw material powder is bound between the lower punch and the die and if the raw material powder is a rare-earth alloy powder.

SUMMARY OF THE INVENTION

It is therefore a primary object of the present invention to provide a forming method and a forming apparatus capable of supplying the raw material powder into the cavity at a high speed even if the compact to be formed is small, and the ratio of the area of the opening to the depth of the cavity is small due to a shape of the compact, and capable of performing an uninterrupted forming operation without such troubles as the seizure caused by a so-called powder clogging.

According to an aspect of the present invention, there is provided a forming method comprising: a powder supplying step of allowing a raw material powder to fall into a cavity of a die by bringing a raw material powder supplying means stored with the raw material powder above the cavity while an inside of the raw material powder supplying means and an inside of the cavity are each maintained at a pressure not greater than 10 kPa, the raw material powder having an average grain diameter of 0.1 $\mu$m~500 $\mu$m; and a press forming step of pressing the raw material powder supplied in the cavity into a compact.

According to another aspect of the present invention, there is provided a forming apparatus comprising: a die formed with a through hole for provision of a cavity, a raw material powder supplying means stored with a raw material powder having an average grain diameter of 0.1 $\mu$m~500 $\mu$m, allowing the raw material powder to fall into the cavity from above the cavity; a pressure maintaining means for keeping an inside of the raw material powder supplying means and an inside of the cavity each at a pressure not greater than 10 kPa at least while the raw material powder supplying means is above the cavity; and a press forming means for pressing the raw material powder supplied in the cavity into a compact.

The pressure inside the cavity is set to a value not greater than 10 kPa, because if the pressure in the cavity is greater than 10 kPa, the gas within the cavity is compressed by the raw material powder, and the pressure in the cavity is increased, reducing the falling speed of the raw material powder. In addition, the compact will not have a uniform density due to interference by the residual gas during the press forming. With the above arrangement, even if the ratio of the area of the opening to the depth of the cavity is small, the raw material powder can be supplied into the cavity smoothly and at a high speed. Further, since the inside of the raw material powder supplying means is also maintained at a pressure not greater than 10 kPa, there is virtually no pressure difference between the inside of the raw material powder supplying means and the inside of the cavity. Thus, the raw material powder falls from the raw material powder supplying means into the cavity solely by gravity. As a result, there is practically no case where the raw material powder enters the gap between the die and the lower punch as experienced when a big pressure difference is created between the two. Therefore, it becomes possible to perform an uninterrupted forming operation at a high speed, without such troubles as caused by the powder clogging.

Preferably, when the raw material powder is supplied into the cavity, the raw material powder supplying means is vibrated by activating a vibrating device, for example, provided in the raw material powder supplying means for activation at least while the raw material powder supply means is above the cavity. By vibrating the raw material powder supply means, even if the area of the opening of the cavity is small, it becomes possible to avoid the bridging phenomenon of the raw material powder, and to supply the raw material powder into the cavity at a high speed. Therefore, it becomes possible to form the compact even with less interruption and at a higher speed.

Further, preferably, the raw material powder supplying means includes a hose. The hose has at least an end portion movable between a position above the cavity and an evacuation position away from the position above the cavity, and the raw material powder is supplied into the cavity from this end portion of the hose when the end portion is at the position above the cavity, for example. With such an arrangement, the end portion of the hose may simply be moved horizontally in order to make virtual evacuation of the raw material powder supplying means from the position above the cavity.

According to the present invention, preferably, the cavity is formed with an opening having an area not greater than 25 $mm^2$. According to the present invention, even if the area of the opening of the cavity is as small as above, the compact can be formed uninterruptedly and at a high speed.

Further, preferably, the raw material powder is a granulated powder having an average grain diameter of 20 $\mu$m~500 $\mu$m granulated by adding a binder to a powder having an average grain diameter of 0.1 $\mu$m~10 $\mu$m. Such a granulated powder, which has a dramatically smaller contact area among granules and thus having an improved flowability, can further improve the falling speed of the powder into the cavity. The average grain diameter of the granulated powder should be 20 $\mu$m~500 $\mu$m. This is because the improvement in flowability is not sufficient if the average grain diameter is smaller than 20 $\mu$m, whereas the average grain diameter greater than 500 $\mu$m decreases a powder density of the granulated powder, making the forming operation difficult. As a result, it becomes possible to further increase the forming speed while maintaining good quality of the formed compact.

Further, preferably, the raw material powder includes a rare-earth alloy powder. A rare-earth alloy powder can be oxidized to ignition if the powder clogging develops. However, since the powder clogging can be prevented according to the present invention, such a firing accident can be prevented even if the raw material powder includes a rare-earth alloy powder.

According to still another aspect of the present invention, there is provided a forming apparatus comprising: a die formed with a through hole for provision of a cavity, a raw material powder supplying portion stored with a raw material powder having an average grain diameter of 0.1 $\mu$m∞500 $\mu$m, movable between a position above the cavity and an evacuation position away from the position above the cavity, allowing the raw material powder to fall into the cavity from above the cavity; an airtight member for keeping airtight at least an inside of the raw material powder supplying portion, a vacuum pump for bringing the inside of the raw material powder supplying portion and an inside of the cavity each at a pressure not greater than 10 kPa at least while the raw material powder supplying portion is above the cavity; and a pair of punches for pressing the raw material powder supplied in the cavity into a compact.

The above object, other objects, characteristics, aspects and advantages of the present invention will become clearer from the following detailed description of embodiments to be presented with reference to the accompanying drawings.

DETAILED DESCRIPTION OF THE PREFERRED EMBODIMENT

Embodiments of the present invention will be described here below with reference to the attached drawings.

(Embodiment 1)

Figure 1:
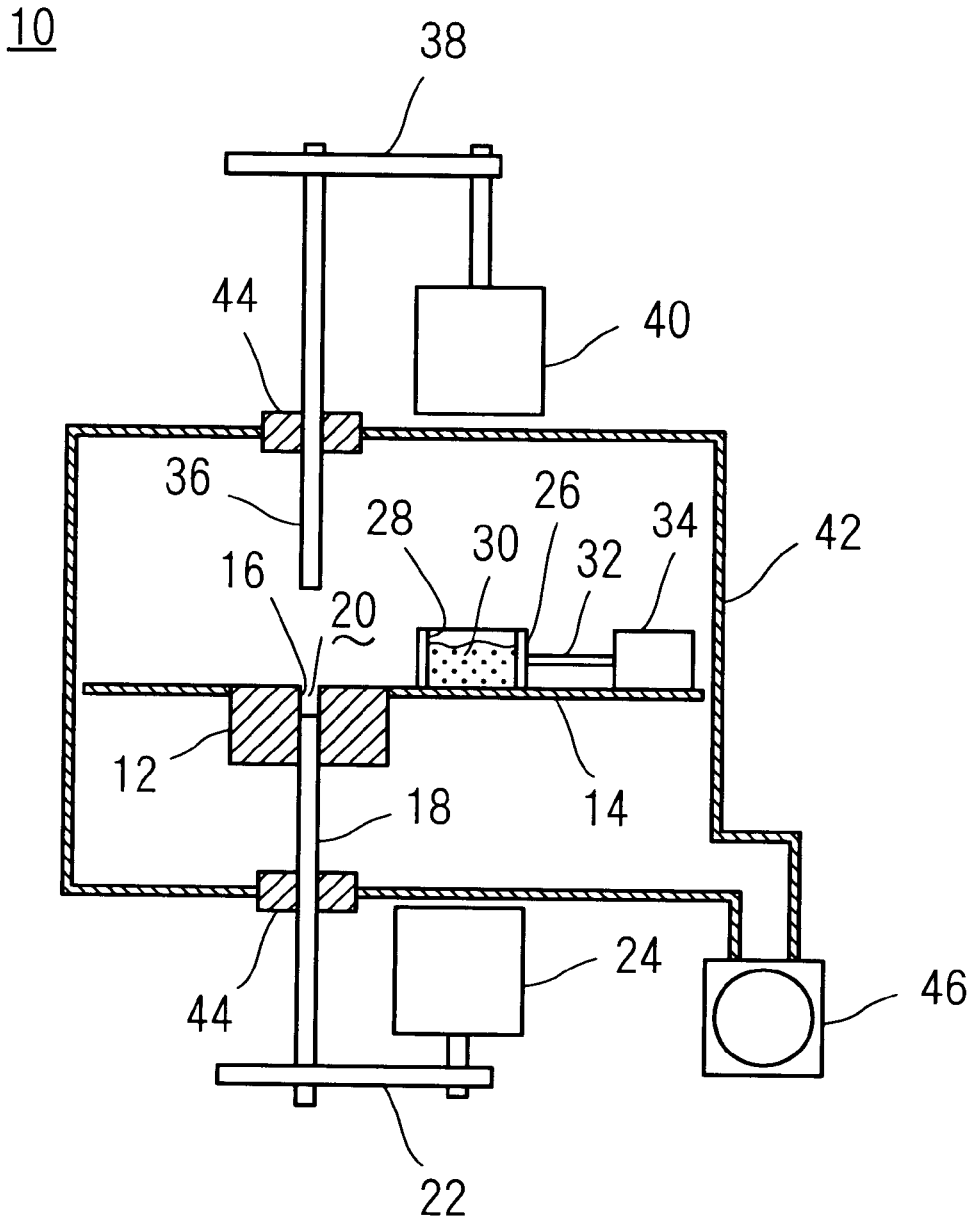
FIG. 1 is a schematic diagram of a forming apparatus as an embodiment 1 of the present invention.

Referring now to FIG. 1, a forming apparatus 10 as an embodiment 1 according to the present invention comprises a die 12 provided generally at a vertically center portion. The die 12 is surrounded by a die plate 14. The die plate 14 has a horizontal upper surface at the same height as that of an upper surface of the die 12. The die 12 is formed with a vertical through hole 16. The through hole 16 is slidably inserted by an upper end portion of a lower punch 18. With this arrangement, there is formed an upward opening cavity 20 within the through hole 16 at a portion above an upper end surface of the lower punch 18.

The lower punch 18 has a lower end portion connected with a lower punch driving motor 24 via a connecting member 22. The lower punch driving motor 24 moves the lower punch 18 vertically relative to the die 12. According to the vertical movement of the lower punch 18 the cavity 20 can have a varying depth. In the embodiment 1, a ratio of an area of the opening of the cavity 20 to the depth thereof is set to a considerably small value.

The die plate 14 is provided, on its upper surface, with a feeder box 26 as a raw material powder supplying means. The feeder box 26 is formed with a vertical through room as a powder storing portion 28. The powder storing portion 28 stores a raw material powder 30. The feeder box 26 is connected with a box driving motor 34 via a rod 32, being moved by the box driving motor 34 in a reciprocating manner between a position above the cavity 20 and an evacuated position (the position shown in FIG. 1) away from the position above the cavity 20. In other words, the feeder box 26 slides on the upper surfaces of the die 12 and the die plate 14, supplying the cavity 20 with the raw material powder 30 by gravitational fall when the feeder box 26 is above the cavity 20. It should be noted here that the lower end of the powder storing portion 28 has an opening of an area significantly greater than the area of the opening of the cavity 20.

An upper punch 36 is provided above the cavity 20. The upper punch 36 has an upper end portion connected with an upper punch driving motor 40 via a connecting member 38. The upper punch driving motor 40 moves the upper punch 36 vertically. The upper punch 36 has a lower end portion to be inserted into the through hole 16 (cavity 20) of the die 12 when the upper punch 36 is lowered, so that the raw material powder 30 supplied in the cavity 20 is pressed by the upper punch 36 and the lower punch 18 into a compact 48 (to be described later). Thus, the upper punch 36 and the lower punch 18 constitute a press forming means.

The raw material powder 30 may be a powder made of metal, alloy, intermetallic compound, semiconductor or ceramic and so on, or a mixture or a composite of these. There is no limitation to the method of manufacture or the form of the raw material powder 30, or characteristics of a crystal grain for example in the powder material 30. However, an average grain diameter of the raw material powder 30 should be 0.1 μm~500 μm. This is because the average grain diameter smaller than 0.1 μm makes manufacture of the raw material powder 30 practically difficult, whereas the average grain diameter greater than 500 μm makes the press forming operation difficult. An example of the rare-earth alloy powder having a poor flowability is an R—Fe—B magnetic powder of a composition disclosed in U.S. Pat. No. 4,770,723. Particularly, out of many R—Fe—B magnetic powders, a raw material powder manufactured by a strip casting process disclosed in U.S. Pat. No. 5,383,978 has an especially poor flowability due to its grain-size distribution represented by a sharp curve. Further, the raw material powder 30 of the above kinds may also be added in advance with a solid or liquid lubricant for improved flowability or compressibility.

Further, the raw material powder 30 may be a granulated powder made by adding a binder to a powder having an average grain diameter of 0.1 μm~10 μm into the average grain diameter (secondary grain diameter) of 20 μm~500 μm. The average grain diameter of the granulated powder should be 20 μm~500 μm. This is because the improvement in flowability is not sufficient in the average grain diameter smaller than 20 μm, whereas the average grain diameter greater than 500 μm decreases a powder density of the granulated powder, making the forming operation difficult. The granulated powder may be manufactured by one of publicly known technologies such as a spray granulating method, fluidizing granulating method and a rolling granulating method.

The die 12, the die plate 14, the feeder box 26, and the box driving motor 34 are provided inside of an airtight container 42 which constitutes an airtight member. The lower portion of the upper punch 36 and the upper portion of the lower punch 18 are respectively inserted in the airtight container 42 via sealing members 44. The airtight container 42 is connected with a vacuum pump 46. The vacuum pump 46 maintains the inside of the whole airtight container 42 at a pressure not greater than 10 kPa. In other words, the airtight container 42 and the vacuum pump 46 constitute a pressure maintaining means for maintaining inside of the powder storage portion 28 of the feeder box 26 and inside of the cavity 20 each at a pressure not greater than 10 kPa.

With the above arrangements, operation of the forming apparatus 10 for forming the compact 48 by pressing will now be described with reference to FIG. 2.

An initial state is identical with a state in which a previous cycle of the forming operation is completed. Specifically, the lower punch 18 and the upper punch 36 are both at their respective ends of upstroke (See FIG. 2(*a*)). At this state, though not illustrated, the feeder box 26 is located at the evacuation position, and the powder storage portion 28 of the feeder box 26 is stored with the raw material powder 30.

Figure 2:
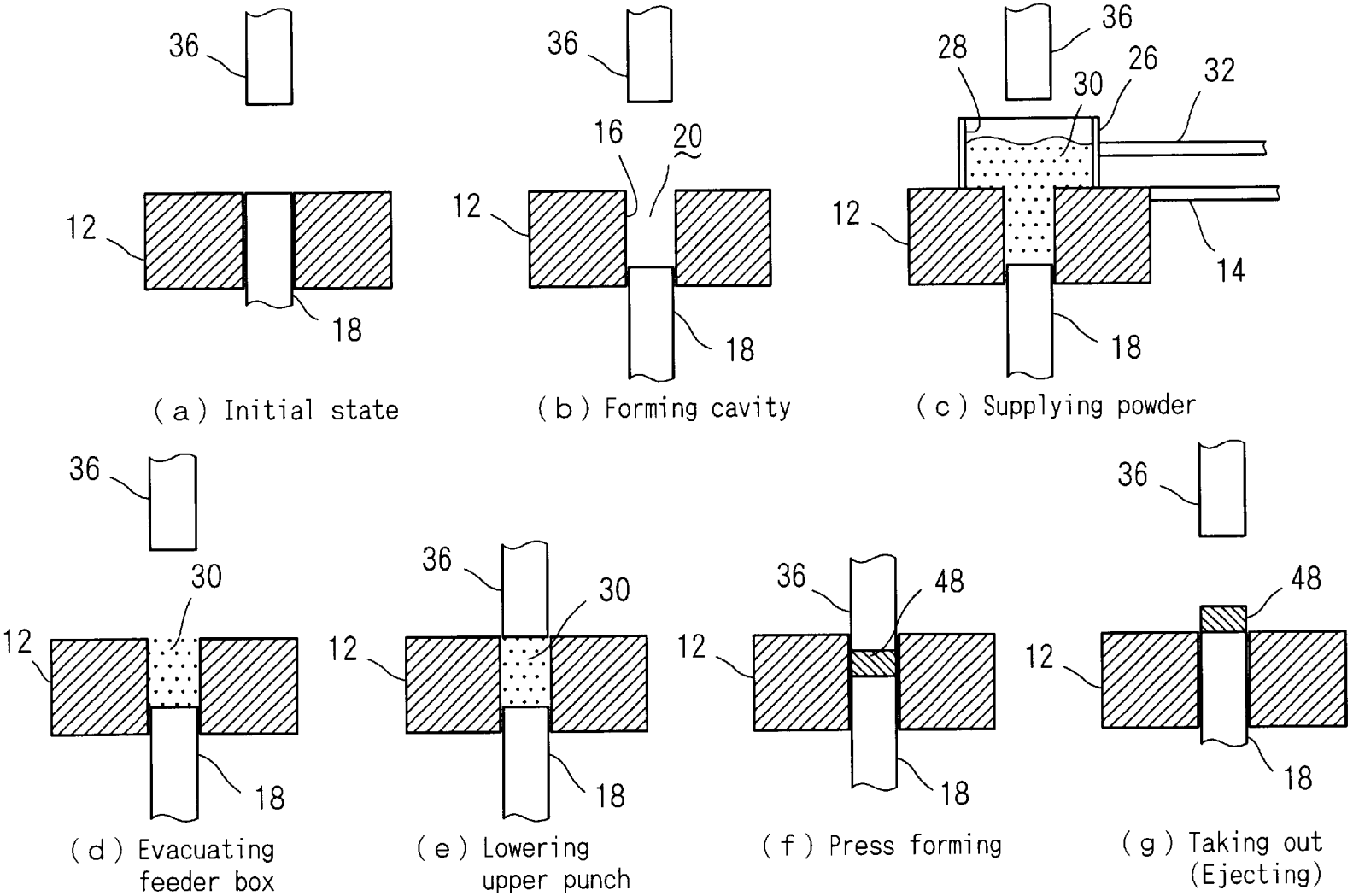
FIG. 2 is a diagram showing a sequence of press forming operation according to the embodiment 1.

Then, the cavity 20 is formed (See FIG. 2(*b*)). Specifically, while the upper punch 36 is held at its end of the upstroke, the lower punch 18 is brought to a position so as to set a depth of the cavity 20 to a certain value which is predetermined based on a height of the compact 48. Further, the pressure in the airtight container 42 is reduced to a value not greater than 10 kPa by the vacuum pump 46.

Next, the box driving motor 34 moves the feeder box 26 to the location above the cavity 20 (See FIG. 2(*c*)). In this operation, the following problems will develop if there is a big difference between the pressure inside the powder storage portion 28 of the feeder box 26 and the pressure inside the cavity 20. Specifically, if the pressure in the cavity 20 is greater than the pressure in the powder storage portion 28, then the pressure difference will make difficult the supply of the raw material powder 30 into the cavity 20. On the other hand, if the pressure in the powder storage portion 28 is greater than the pressure in the cavity 20, the raw material powder 30 is supplied into the cavity 20 with a high pressure gas. The high pressure gas will discharge from a gap between the through hole 16 of the die 12 and the lower punch 18, causing the raw material powder 30 to enter the gap, resulting in so-called powder clogging, sometimes making impossible to drive the lower punch 18. However, according to the embodiment 1, the pressure in the powder storage portion 28 of the feeder box 26 and the pressure in the cavity 20 are each maintained at a pressure not greater than 10 kPa. Since there is virtually no pressure difference between the two, the raw material powder 30 falls from the feeder box 26 into the cavity 20 solely by gravity, practically eliminating the case where the raw material powder 30 enters the gap between the through hole 16 of the die 12 and the lower punch 18.

Further, if the pressure in the cavity 20 is greater than 10 kPa, when the raw material powder 30 falls, the gas within the cavity 20 is compressed by the raw material powder 30, increasing the pressure in the cavity 20. This reduces the falling speed of the raw material powder 30. In addition, the compact 48 will not have a uniform density due to interference by the residual gas during the press forming operation. However, no such problems will develop according to the embodiment 1, since the pressure in the cavity 20 is maintained not greater than 10 kPa. Further, under such a low pressure, an amount of moisture attached onto the surface of the raw material powder 30 decreases, thus improving the flowability of the powder. As a result, even if the ratio of the area of the opening to the depth of the cavity is small, and even if the residual gas has a high pressure or a high viscosity, it becomes possible to supply the raw material powder 30 into the cavity 20 smoothly and at a high speed.

Next, the feeder box 26 is evacuated (See FIG. 2(*d*)), and then the upper punch driving motor 40 moves down the upper punch 36 (See FIG. 2(*e*)), so that the raw material powder 30 supplied in the cavity 20 is pressed by the upper punch 36 and the lower punch 18 to form the compact 48 (See FIG. 2(*f*)). Then, the lower punch driving motor 24 moves up the lower punch 18 so that the upper end surface of the lower punch 18 becomes generally flush with the upper surface of the die 12, and the compact 48 is taken out of the through hole 16 (See FIG. 2(*g*)).

The compact 48 thus obtained may or may not be sintered eventually. If not sintered, the compact 48 may be a finished product as it is or may be added with a binder such as a resin to form a finished product (such as a bond magnet).

As described above, according to the embodiment 1, the pressure inside the whole airtight container 42 is maintained not greater than 10 kPa while the raw material powder 30 stored in the powder storage portion 28 of the feeder box 26 is allowed to fall into the cavity 20. As a result, the troubles caused by the powder clogging are prevented, the raw material powder 30 can be supplied uniformly into the cavity 20, and the forming speed can be increased. Further, even if the compact 48 to be formed is of a small dimension, which requires the cavity 20 to have the area of opening not greater than 25 $mm^2$ for example, a better yield can be achieved as compared with manufacture by cutting.

In addition, if the raw material powder 30 is a rare-earth alloy powder susceptible to oxidization during the pressing operation (such as a neodymium alloy powder), the oxidization of the raw material powder 30 can also be prevented, making possible to improve magnetic characteristics of the obtained magnet, compared with the magnet manufactured by press forming process under an atmospheric pressure.

It should be noted here that according to the embodiment 1, the die 12, the die plate 14, the feeder box 26, and the box driving motor 34 are provided within the airtight container 42. However, if the forming apparatus 10 as a whole is not very large, the forming apparatus 10 can be placed entirely within the airtight container 42. Such an arrangement can eliminate the sealing members 44, making possible to improve air-tightness of the airtight container 42 as well as eliminate sliding resistance of the upper punch 36 and the lower punch 18 with respective sealing members 44. Further, it should be noted that at least, only the pressure inside the powder storage portion 28 of the feeder box 26 and the pressure inside the cavity 20 must be maintained not grater than 10 kPa. In such an arrangement, the airtight container 42 may not be provided. Instead, the powder storage portion 28 of the feeder box 26 is made airtight by a lid member (not illustrated) as an airtight member provided on top of the powder storage portion 28. Then, air is sucked from both the powder storage portion 28 and the cavity 20 by the vacuum pump 46. During the above operation, if the pressure inside the powder storage portion 28 of the feeder box 26 and the pressure inside the cavity 20 are both not greater than 10 kPa, a pressure difference between the two is virtually null, and therefore no problem will be caused. In a practical sense, however, there is a possibility that air enters from the gap between the lower punch 18 and the die 12, as well as from a gap between the feeder box 26 and the die 12. Further, the pressure inside the powder storage portion 28 and the pressure inside the cavity 20 should ideally be equalized with each other. For these reasons, it is preferable that at least the feeder box 26 and the die 12 should be placed within the airtight container 42.

(Embodiment 2)

Figure 3:
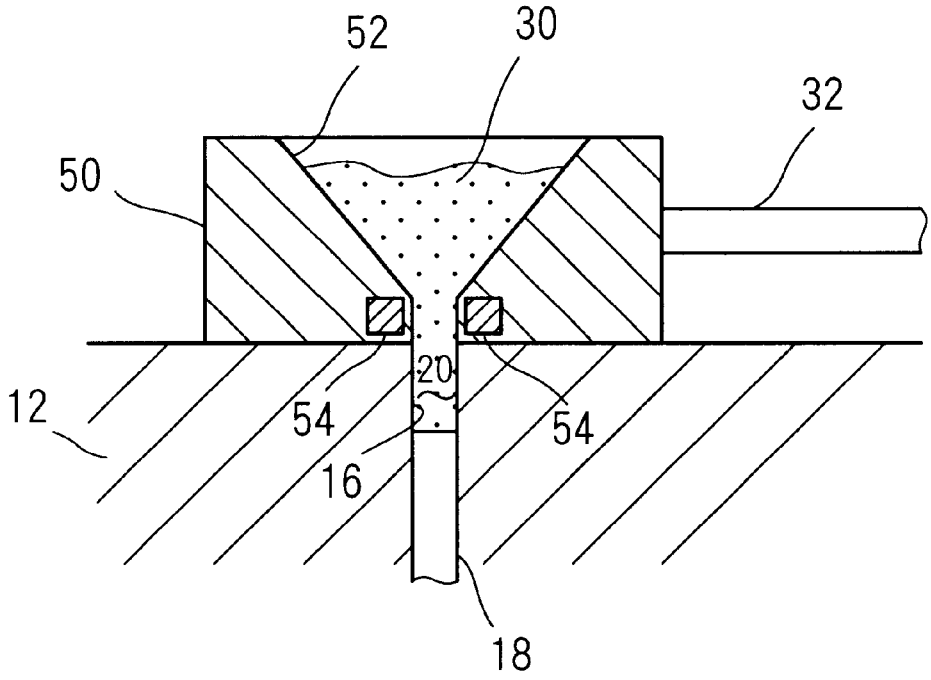
FIG. 3 is an enlarged sectional view of a primary portion of an forming apparatus as an embodiment 2.

Next, reference will be made to FIG. 3 for describing an embodiment 2 according to the present invention.

It should be noted that in each of the following embodiments, components identical with those already referred to in FIG. 1 will be referred to by the same numeral code and will not be detailed.

The embodiment 2 makes use of a feeder box 50 provided with a powder storage portion 52 having a different shape than in the embodiment 1.

Specifically, according to the embodiment 2, the powder storage portion 52 of the feeder box 50 is formed vertically but so as to have an downwardly decreasing sectional area (like a funnel for example). A lower end of the powder storage portion 52 has a shape and an area generally identical with those of the opening of the cavity 20. Further, the powder storage portion 52 is formed so that the lower end portion of the powder storage portion 52 will be generally right above the cavity 20 when the feeder box 50 is above the cavity 20.

Further, two supersonic vibrators 54 are provided around the lower end portion of the powder storage portion 52 and as opposed to each other. The supersonic vibrators 54 should preferably be magnetostrictive vibrators. However, crystal vibrators or piezoelectric ceramic vibrators and so on may be used instead.

Each of the supersonic vibrators 54 is activated when the feeder box 50 is above the cavity 20. Specifically, when the feeder box 50 is above the cavity 20, the supersonic vibrators 54 are activated while the raw material powder 30 is being supplied into the cavity 20 from the lower end portion of the powder storage portion 52 by gravitational fall. Then, the rest of the cycle, identical with the corresponding steps according to the embodiment 1, is performed for forming the compact 48.

It should be noted that a powder supply portion including the feeder box 50 and the supersonic vibrators 54 is commercially available as ULCON Powder Dispenser (product name) manufactured by SATTAS Co., Ltd. and Supersonic Motor-Driven Powder Feeder (product name) manufactured by Aisan Kogyo Co., Ltd., for example.

According to the embodiment 2, the sectional area of the lower end portion of the powder storage portion 52 is substantially smaller than that of the embodiment 1. As a result, when the feeder box 50 is sliding on the upper surface of the die 12 or die plate 14, substantially smaller amount of the raw material powder 30 is rubbed against the upper surface of the die 12 by the sliding motion. This reduces an amount of fine grains resulting from the raw material powder 30 crushed by the rubbing action, making possible to reduce an amount of raw material powder 30 entering the gap between the die 12 and the lower punch 18. Further, if the raw material powder 30 is a granulated powder, the above advantage of reducing the amount of fine grains resulting from crushed granules also helps maintain the good flowability of the powder. Thus, even if the lower end portion of the powder storage portion 52 has a small sectional area, each of the supersonic vibrators 54 is vibrated to avoid the bridging phenomenon of the raw material powder 30 when the feeder box 50 is above the cavity 20. Thus it becomes possible to supply the raw material powder 30 into the cavity 20 uniformly and at a high speed. As a result, the same function and effect as achieved in the embodiment 1 are obtained.

It should be noted that according to the embodiment 2, two supersonic vibrators 54 are provided around the lower end portion of the powder storage portion 52 of the feeder box 50, facing each other. However, only one supersonic vibrator 54 or three or more of them may be provided. Further, the supersonic vibrator 54 may be provided at any location as long as around the lower end portion of the powder storage portion 52. Further, the supersonic vibrator 54 may be replaced by a vibrating device having a lower frequency such as a vibrator motor.

Further, each of the supersonic vibrators 54 may be held activated while the feeder box 50 is on the move and at the evacuation position. However, in order to prevent the raw material powder 30 from being finely crushed, the activation should preferably made only when the feeder box 50 is above the cavity 20 as in the embodiment 2.

Further, according to the embodiment 2, the powder storage portion 52 of the feeder box 50 is made to have a downwardly decreasing sectional area. However, this is not the only acceptable shape, but the powder storage portion 52 may be shaped in any other way.

(Embodiment 3)

Figure 4:
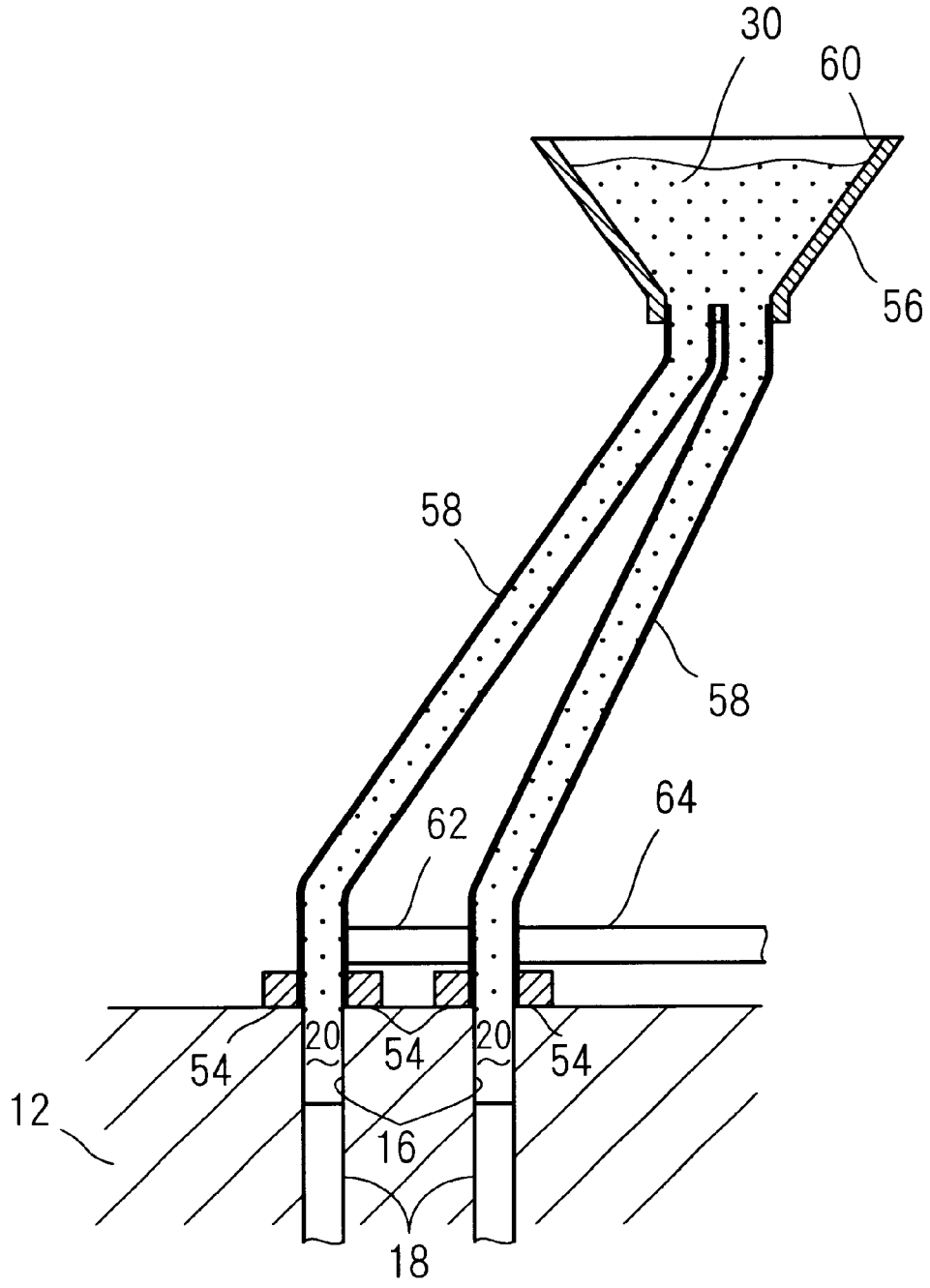
FIG. 4 is an enlarged sectional view of a primary portion of a forming apparatus as an embodiment 3.

Reference is made now to FIG. 4 for describing an embodiment 3 according to the present invention.

According to the embodiment 3, the feeder box 26 (50) is replaced by a hopper 56 stored with the raw material powder 30, and two elastic rubber hoses 58 each provided generally vertically and having an upper end portion connected to a lower end portion of the hopper 56. Further, the die 12 has two cavities 20.

More specifically, according to the embodiment 3, the hopper 56 is fixed to a non-movable object (not illustrated) so as to stay above the die 12. A powder storage portion 60 of the hopper 56 is formed vertically, having a downwardly decreasing sectional area as is the powder storage portion 28 of the feeder box 26 according to the embodiment 2.

Lower end portions of respective hoses 58 are connected with each other by a connecting member 62 so that the lower end portions are horizontally apart from each other by a distance generally equal to a distance between the two cavities 20 in the die 12. The lower end portion of one hose 58 (the right hand hose in FIG. 4) is connected with a hose driving motor (not illustrated) via a rod 64 as is the feeder box 26 according to the embodiment 1. The hose driving motor moves the lower end portion of each of the hoses 58 between a position above the corresponding cavity 20 and an evacuation position away from the position above the cavity 20. Specifically, the lower end portion of each of the hoses 58 slides on the upper surface of the die 12 or die plate 14. During the sliding movement, each of the hoses 58 elastically deforms according to its position. It should be noted that a sectional shape and area of the lower end portion of each of the hoses 58 are made to be generally identical with the opening of the corresponding cavity 20.

Further, asaccording to the embodiment 2, each of the hoses 58 is provided with two supersonic vibrators 54 facing each other around the lower end portion. Each of the supersonic vibrators 54 is activated when the lower end portion of the corresponding hose 58 is above the corresponding cavity 20. Specifically, when the lower end portion of each of the hoses 58 is above the corresponding cavity 20, the supersonic vibrators 54 are activated and the raw material powder 30 stored in the hopper 56 is supplied into the cavity 20 through each of the hoses 58 by gravitational fall. Then, the rest of the cycle, identical with the corresponding steps according to the embodiment 1, is performed for forming the compact 48.

According to the embodiment 3, the sectional shape and area of the lower end portion of the hoses 58 are made generally identical with those of the opening of the corresponding cavity 20. As a result, like in the embodiment 2, even when the lower end portions of the hoses 58 are sliding on the upper surface of the die 12, the raw material powder 30 can be better protected from being crushed into smaller grains. This reduces an amount of fine grain resulting from the raw material powder 30. Further, if the raw material powder 30 is a granulated powder, the granulated powder can be better protected from being crushed. Then, by activating the supersonic vibrators 54, the raw material powder 30 can be supplied into the cavities 20 at a high speed.

Further, since the hoses 58 are elastic, only the lower end portions thereof may be horizontally moved in order to achieve a virtual and easy evacuation of the hopper 56 from the position above the cavities 20.

Further, both of the two cavities 20 can be supplied uniformly with the raw material powder 30. Since the same advantage can be obtained even if a larger number of cavities are provided, it becomes possible to form a large number of uniform compacts easily out of a single cycle.

Further, since each of the hoses 58 is substantially lighter than the feeder box 26 (50) stored with the raw material powder 30, the hoses 58 can be moved at a higher speed than the feeder box 26 (50), reducing further the formation time.

It should be noted that according to the embodiment 3, again as in the embodiment 2, only one supersonic vibrator 54 or three or more of them may be provided. Further, the supersonic vibrator 54 may be provided at any location as long as around the lower end portion of each of the hoses 58. Further, again as in the embodiment 2, a different vibrating device having a vibrating frequency lower than a supersonic wave for example may be used.

Further, as in the embodiment 2, each of the supersonic vibrators 54 may be held activated while each of the lower end portions of the hoses 58 is on the move and at the evacuation position.

Further, according to the embodiment 3, each of the hoses 58 is made of rubber. However, any elastic material may be used instead of the rubber. Moreover, as long as the lower end portion of each of the hoses 58 can be moved horizontally, or if the hopper 56 can be moved integrally with the hoses 58, the hoses 58 may not be elastic.

Next, description will be made for experiments.

(Experiment 1)

One kilogram of carbonyl iron powder having an average grain diameter of 4.2 $\mu$m was added with 30 g of 10% water solution of polyvinyl alcohol as a binder. The mixture was further added with water, and stirred to obtain slurry of 70% concentration. The slurry was supplied to a spray dryer, and spray-dried to obtain a granulated powder having an average grain diameter (secondary grain diameter) of 170 $\mu$m.

Then, the granulated powder was loaded to a powder storage portion of a feeder box of a forming apparatus. This forming apparatus was enclosed entirely in an airtight container, but all the other aspects were the same as in the embodiment 1. After the granulated powder was loaded into the powder storage portion, air in the airtight container was discharged by a vacuum pump to reduce a pressure inside the airtight container to 1 kPa.

Next, a box driving motor was activated to make a single reciprocating sliding travel of the feeder box to above and back from a cavity having a circular opening of a diameter of 1.5 mm provided in a die, for supplying the granulated powder stored in the powder storage portion of the feeder box into the cavity by gravitational fall.

Then, the granulated powder in the cavity was pressed by an upper punch and a lower punch. The obtained compact was raised by the lower punch and was taken out of the die.

The above forming cycle was continuously repeated. During the experiment, an rpm of the box driving motor was varied so as to vary the number of compacts to be formed per hour. The number of compacts achieved per hour was proportional to the rpm of the box driving motor. The pressure in the airtight container during the forming operation was constant at 1 kPa.

Next, after air was introduced into the airtight container, the obtained compacts were taken out of the airtight container. These compacts were removed of the binder at 500° C. under vacuum for 2 hours, and then sintered at 1100° C. for 2 hours.

(Comparison 1)

The same granulated powder as made in the experiment 1 was loaded into the same powder storage portion of the feeder box of the forming apparatus as used in the experiment 1. Forming operation was made without pressure reduction, under an atmospheric pressure of 100 kPa. The obtained compacts were sintered under the same conditions as in the experiment 1.

Comparison was made for products made in the experiment 1 and the comparison 1. For each of the formation speeds, the number of compacts produced per hour was measured, and measurement was made to 100 pieces of sintered pieces for a height and parallelism between the upper and lower surfaces.

The results of the measurements were summarized in Table 1 in criteria of average height, standard deviation of the height and average parallelism. The results show that if the pressure in the airtight container is reduced, stable powder supply and formation become possible even if a time used for supplying the powder is reduced, making possible to manufacture the compact or the sintered piece superior in the dimensional accuracy.

TABLE 1

| | Number of Compacts per Hour | Height (mm) Average | Standard Deviation | Parallelism (%) Average |
|---|---|---|---|---|
| Experiment 1 | 400 | 3.75 | 0.03 | 0.6 |
| | 800 | 3.68 | 0.03 | 0.7 |
| | 1200 | 3.57 | 0.04 | 0.9 |
| | 1600 | 3.21 | 0.05 | 1.1 |
| | 2000 | 3.18 | 0.06 | 1.3 |
| Comparison 1 | 400 | 3.73 | 0.05 | 0.8 |
| | 800 | 3.55 | 0.16 | 1.5 |
| | 1200 | 2.86 | 0.86 | 2.3 |
| | 1600 | * | — | — |
| | 2000 | * | — | — |

*Powder could not be supplied.

(Experiment 2)

A raw material powder of Mn—Zn ferrite having an average grain diameter of 0.2 μm was added and mixed with 0.1% of zinc stearate as a lubricant in advance. The mixture was loaded to a powder storage portion of a feeder box of a forming apparatus generally the same as used in the experiment 1. Then, air in the airtight container was discharged by a vacuum pump, and a pressure inside the airtight container was adjusted to a value not greater than 10 kPa.

Next, a box driving motor was activated to make a single reciprocating sliding travel of the feeder box to above and back from a cavity having a rectangular opening of a side of 5.0 mm formed in a die, for supplying the raw material powder stored in the powder storage portion of the feeder box into the cavity by gravitational fall.

Then, the raw material powder in the cavity was pressed by an upper punch and a lower punch. The obtained compact was raised by the lower punch and was taken out of the die.

The above forming cycle was continuously repeated. The number of compacts formed per hour was set to 2000. The pressure in the airtight container during the forming operation was constant at the value of the initial setting.

Next, after air was introduced into the airtight container, the obtained compacts were taken out of the airtight container. These compacts were sintered at 1250° C. for 4 hours in the atmosphere.

(Comparison 2)

The same formation as made in the experiment 2 was performed except that the pressure of the airtight container was set to a value above 10 kPa. All the other forming conditions were maintained the same as in the experiment 2. The obtained compacts were sintered under the same conditions as in the experiment 2.

Comparison was made for products made in the experiment 2 and the comparison 2. For each of the varied pressure conditions in the airtight container at the time of press forming, 100 pieces of sintered pieces were subjected to measurement of the height and parallelism between the upper and lower surfaces.

The results of the measurements were summarized in Table 2 in the criteria of average height, standard deviation of the height and average parallelism. The results show that if the pressure in the airtight container is made not greater than 10 kPa, as smooth powder supply as under a higher vacuum becomes possible, making possible to manufacture the compact or the sintered piece superior in the dimensional accuracy.

TABLE 2

| | Pressure in Airtight Container (kPa) | Height (mm) Average | Standard Deviation | Parallelism (%) Average |
|---|---|---|---|---|
| Experiment 2 | 1 | 2.55 | 0.06 | 0.5 |
| | 3 | 2.54 | 0.06 | 0.5 |
| | 5 | 2.54 | 0.07 | 0.7 |
| | 8 | 2.53 | 0.08 | 1.0 |
| | 10 | 2.51 | 0.09 | 1.1 |
| Comparison 2 | 12 | 2.06 | 0.29 | 2.5 |
| | 20 | 1.84 | 0.68 | 3.7 |
| | 50 | * | — | — |
| | 100 | * | — | — |

*Powder could not be supplied.

(Experiment 3)

One kilogram of a Neodymium-Iron-Boron raw material powder of a composition as disclosed in U.S. Pat. No. 4,770,723, comprising 31.0 weight % of neodymium, 1.0 weight % of Boron, and the remaining portion occupied by iron with unavoidable inclusion of foreign elements, having an average grain diameter of 3.0 μm was added with 30 g of 10% water solution of polyvinyl alcohol as a binder. The mixture was further added with water, and stirred to obtain slurry of 70% concentration. The slurry was supplied to a spray dryer, and spray-dried to obtain a granulated powder having an average grain diameter (secondary grain diameter) of 80 μm.

Then, the granulated powder was loaded to a powder storage portion of a feeder box of a forming apparatus. This forming apparatus was enclosed entirely in an airtight container. All the aspects but a portion of the feeder box were the same as in the embodiment 1. The feeder box portion was the same as in the embodiment 2. Further, an electric magnet was provided on a surface of a die for creating a magnetic field in the cavity of the die when energized. After the granulated powder was loaded into the powder storage portion, air in the airtight container was discharged by a vacuum pump to reduce a pressure inside the airtight container to 1 kPa.

Next, a box driving motor was activated to move the feeder box to above the cavity having an opening of a circular section of a diameter of 5.0 mm and a depth of 5.0 mm provided in the die. The supersonic vibrator was vibrated while the granulated powder stored in the powder storage portion of the feeder box is being supplied into the cavity by gravitational fall. Then, the vibration was stopped, and the feeder box was moved back to the original location.

Then, an upper punch was inserted slightly into the die, and the electric magnet was energized so as to create the magnetic field of 1 MA/m within the cavity for orientation of the granulated powder. Then, the oriented powder within the cavity was pressed by an upper punch and a lower punch, the electric magnet was de-energized, and the obtained compact was raised by the lower punch and was taken out of the die.

The above forming cycle was continuously repeated. During the operation, the number of compacts formed per hour was set to 2000. The pressure in the airtight container during the forming operation was constant at 1 kPa.

Next, after air was introduced into the airtight container, the obtained compacts were taken out of the airtight container.

Next, the die was replaced with another die formed with an opening of a diameter of 3.0 mm. The powder storage portion of the feeder box of the forming apparatus was replenished with the granulated powder, and then the above forming cycle was continuously repeated. The cavity of the new die was set to a depth of 5.0 mm and was not varied.

Using the same procedures as above, formation was also performed for dies with openings of 2.0 mm, 1.5 mm, 1.0 mm diameters respectively. All of the obtained compacts were removed of the binder at 500° C. in a hydrogen atmosphere for 2 hours, and then sintered at 1080° C. for 2 hours.

(Comparison 3)

The same granulated powder as made in the experiment 3 was loaded into the powder storage portion of the feeder box of the same forming apparatus as used in the experiment 3. The same continuous forming operation under the same conditions as in the experiment 3 was made, except that the operation was made under an atmospheric pressure of 100 kPa without the pressure reduction. The obtained compacts were sintered under the same conditions as in the experiment 3.

Comparison was made for products made in the experiment 3 and the comparison 3. For each of the dies having an opening of a different diameter from others, 100 pieces of sintered pieces were subjected to measurement of a height and parallelism between the upper and lower surfaces.

The results of the measurements were summarized in Table 3 in the criteria of average height, standard deviation of the height and average parallelism. The results show that if the pressure in the airtight container is reduced, stable powder supply and formation become possible even if the ratio of the area of the opening to the depth of the cavity is small due to a shape of a compact. Thus, it becomes possible to manufacture the compact or the sintered piece superior in the dimensional accuracy.

TABLE 3

| | Die Opening | Height (mm) | | |
|---|---|---|---|---|
| | Diameter (mm) | Average | Standard Deviation | Parallelism (%) Average |
| Experiment 3 | 5.0 | 2.15 | 0.05 | 0.4 |
| | 3.0 | 1.86 | 0.06 | 0.5 |
| | 2.0 | 1.79 | 0.06 | 0.7 |

TABLE 3-continued

| | Die Opening | Height (mm) | | |
|---|---|---|---|---|
| | Diameter (mm) | Average | Standard Deviation | Parallelism (%) Average |
| | 1.5 | 1.62 | 0.07 | 0.7 |
| | 1.0 | 1.54 | 0.08 | 0.8 |
| Comparison 3 | 5.0 | 1.75 | 0.12 | 0.9 |
| | 3.0 | 1.21 | 0.27 | 1.1 |
| | 2.0 | 0.88 | 0.54 | 1.8 |
| | 1.5 | * | — | — |
| | 1.0 | * | — | — |

*Powder could not be supplied.

The present invention being described and illustrated in detail thus far, it is obvious that these description and drawings only represent an example of the present invention, and should not be interpreted as limiting the invention. The spirit and scope of the present invention is only limited by words used in the accompanied claims.

What is claimed is:

1. A forming method comprising:

a powder supplying step of allowing a raw material powder to fall into a cavity of a die by bringing a raw material powder supplying means stored with the raw material powder above the cavity while an inside of the raw material powder supplying means and an inside of the cavity are each maintained at a pressure not greater than 10 kPa before and during the falling of the raw material powder into the cavity, the raw material powder having an average grain diameter of 0.1 μm~500 μm; and a press forming step of pressing the raw material powder supplied in the cavity into a compact.

2. The method according to claim 1, wherein the raw material powder is supplied into the cavity while the raw material powder supplying means is vibrated in the powder supplying step.

3. The method according to claim 1, wherein the raw material powder supplying means includes a hose for supplying the raw material powder into the cavity, the raw material powder being supplied into the cavity from an end portion of the hose by bringing the end portion of the hose above the cavity in the powder supplying step.

4. The method according to claim 1, wherein the cavity is formed with an opening having an area not greater than 25 $mm^2$.

5. The method according to one of claims 1 through 4, wherein the raw material powder is a granulated powder having an average grain diameter of 20 μm~500 μm granulated by adding a binder to a powder having an average grain diameter of 0.1 μm~10 μm.

6. The method according to one of claims 1 through 4, wherein the raw material powder includes a rare-earth alloy powder.

7. A forming apparatus comprising:

a die formed with a through hole for provision of a cavity, a raw material powder supplying means stored with a raw material powder having an average grain diameter of 0.1 μm~500 μm, allowing the raw material powder to fall into the cavity from above the cavity;

a pressure maintaining means for keeping an inside of the raw material powder supplying means and an inside of the cavity each at a pressure not greater than 10 kPa before and during the falling of the raw material powder into the cavity at least while the raw material powder supplying means is above the cavity; and a press forming means for pressing the raw material powder supplied in the cavity into a compact.

8. The apparatus according claim 7, further comprising a vibrating device provided in the raw material powder supplying means for activation at least while the raw material powder supply means is above the cavity.

9. The apparatus according to claim 7, wherein the raw material powder supplying means includes a hose, at least an end portion of the hose being movable between a position above the cavity and an evacuation position away from the position above the cavity, the raw material powder being supplied into the cavity when the end portion is above the cavity.

10. The apparatus according to claim 7, wherein the cavity is formed with an opening having an area not greater than 25 $mm^2$.

11. The apparatus according to one of claims 7 through 10, wherein the raw material powder is a granulated powder having an average grain diameter of 20 $\mu$m~500 $\mu$m granulated by adding a binder to a powder having an average grain diameter of 0.1 $\mu$m~10 $\mu$m.

12. The apparatus according to one of claims 7 through 10, wherein the raw material powder includes a rare-earth alloy powder.

13. A forming apparatus comprising:

a die formed with a through hole for provision of a cavity, a raw material powder supplying portion stored with a raw material powder having an average grain diameter of 0.1 $\mu$m~500 $\mu$m, movable between a position above the cavity and an evacuation position away from the position above the cavity, allowing the raw material powder to fall into the cavity from above the cavity;

an airtight member for keeping airtight at least an inside of the raw material powder supplying portion, a vacuum pump for bringing the inside of the raw material powder supplying portion and an inside of the cavity each at a pressure not greater than 10 kPa before and during the falling of the raw material powder into the cavity at least while the raw material powder supplying portion is above the cavity; and a pair of punches for pressing the raw material powder supplied in the cavity into a compact.

* * * * *